US008588669B2

(12) United States Patent
Zhang et al.

(10) Patent No.: US 8,588,669 B2
(45) Date of Patent: Nov. 19, 2013

(54) FLOW-COATABLE PFA FUSER TOPCOATS

(75) Inventors: Qi Zhang, Milton (CA); Yu Qi, Oakville (CA); Gordon Sisler, St. Catharines (CA); Carolyn Moorlag, Mississauga (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 147 days.

(21) Appl. No.: 13/182,015

(22) Filed: Jul. 13, 2011

(65) Prior Publication Data

US 2013/0017005 A1 Jan. 17, 2013

(51) Int. Cl.
*G03G 15/20* (2006.01)
*B05D 5/12* (2006.01)

(52) U.S. Cl.
USPC ..... 399/333; 427/144

(58) Field of Classification Search
USPC ..... 427/144; 399/333
See application file for complete search history.

(56) References Cited

U.S. PATENT DOCUMENTS

| | | | | |
|---|---|---|---|---|
| 8,337,986 | B2 * | 12/2012 | Moorlag et al. | 428/421 |
| 2003/0068445 | A1 * | 4/2003 | Bellino et al. | 427/430.1 |
| 2004/0219376 | A1 * | 11/2004 | Maeyama et al. | 428/457 |
| 2007/0190320 | A1 * | 8/2007 | Longhenry et al. | 428/375 |
| 2011/0116849 | A1 * | 5/2011 | Qi et al. | 399/333 |
| 2011/0223436 | A1 * | 9/2011 | Wu et al. | 428/474.4 |

* cited by examiner

*Primary Examiner* — Clayton E Laballe
*Assistant Examiner* — Jas Sanghera
(74) *Attorney, Agent, or Firm* — MH2 Technology Law Group LLP

(57) ABSTRACT

Exemplary embodiments herein provide materials and methods for a fusing apparatus including a fuser member comprising a substrate and a topcoat layer, wherein the topcoat layer comprises a flow-coated fluororesin and has a surface energy of about 25 mN/m or less.

19 Claims, 5 Drawing Sheets

FLOW-COATABLE PFA FUSER TOPCOATS

DETAILED DESCRIPTION

1. Field of the Use

The present teachings relate generally to fuser members used in electrophotographic printing devices and, more particularly, to flow-coatable fluororesins used for the topcoat layer of the fuser members, and methods of producing the same.

2. Background

In a typical electrophotographic reproducing apparatus, a light image of an original to be copied is recorded in the form of an electrostatic latent image upon a photosensitive member. The latent image is subsequently rendered visible by application of electroscopic thermoplastic resin particles which are commonly referred to as toner. The visible toner image is then in a loose powdered form and is usually fused, using a fusing apparatus, upon a support, which may be an intermediate member, or a print medium such as plain paper.

Conventional fusing apparatuses include a fuser member and a pressure member, which may be configured to include a roll pair maintained in pressure contact or a belt member in pressure contact with a roll member. In a fusing process, heat may be applied by heating one or both of the fuser member and the pressure member.

Fuser members can be coated with layers (e.g., topcoat) of materials having low surface energy (to maintain good release properties), adequate flexibility, good thermal conductivity, and/or mechanical robustness (to extend fuser member life). However, few materials have all properties desired. Some materials having low surface energy often have relatively low mechanical strength, reducing fuser member life. Other materials having mechanical robustness can have poor thermal conductivity. Accordingly, combinations of materials must be selected carefully.

Fluoropolymer such as perfluoroalkoxy (PFA) resins are often used in topcoats for fuser members because they possess both low surface energy and high mechanical strength. Among the coating processes available for topcoat application—including spray coating, flow coating, power coating, and dip coating—flow coating has advantages over other processes because it permits high transfer efficiency (e.g., flow coating provides a more efficient metered coating process, resulting in less wasted coating material, as compared to spray coating which involves overspray loss), high production rate, and avoids toxic airborne atomized PFA particles.

PFA topcoats are usually prepared as coatings by spray coating or dip coating from aqueous dispersions, powder coating with PFA powders, or as sleeves by extruding PFA resins. As perfluoroplastics such as PFA, PTFE and FEP are highly crystalline fluoropolymers, they are typically insoluble in organic solvent and melt at high temperatures, i.e. about 260 to about 327° C. Flow-coating PFA resin particles and like fluoroplastics in dispersion requires the coating dispersion to be stable and to have suitable rheology. Suitably stable flow-coatable fluoroplastic topcoat formulations are not presently known in current manufacturing technologies.

To lower manufacturing costs and extend lifetime of fuser members, it is desirable to provide a fuser member material having desired properties (e.g., low surface energy, adequate flexibility, good thermal conductivity, mechanical robustness, etc.) and can be applied by flow coating methods.

SUMMARY

According to embodiments illustrated herein, there is provided a method of producing a fuser member including providing a substrate; providing a dispersion comprising at least one fluororesin, at least one sacrificial polymeric binder, and a solvent; applying the dispersion to the substrate by flow coating to form a topcoat; heating the topcoat to a first temperature ranging from a bout 100° C. to about 280° C.; and heating the topcoat to a second temperature ranging from about 285° C. to about 380° C. to form a uniform topcoat on a fuser member.

According to one embodiment, there is provided a fuser apparatus comprising a fuser member comprising a substrate and a topcoat layer, wherein the topcoat layer comprises a flow-coated fluororesin and has a surface energy of about 25 nM/m or less; and a pressure member configured to form a contact nip with the topcoat layer of the fuser member to fuse toner images on a print medium that passes through the contact nip.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1A:
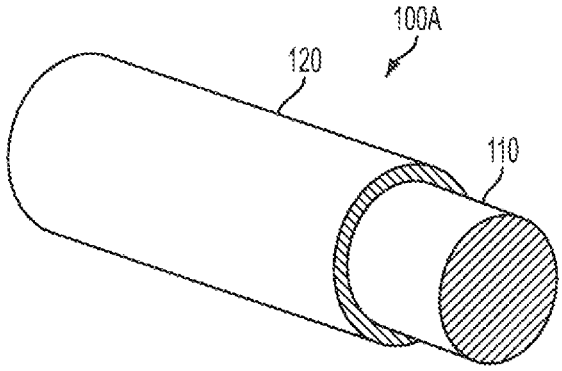
FIGS. 1A-1B depict exemplary fuser rolls having the exemplary non-woven fabrics disclosed herein in accordance with various embodiments of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Exemplary embodiments provide materials and methods for producing a fuser member and a fusing apparatus used in electrophotographic printing devices. The fuser member can include a topcoat comprising a fluororesin applied by flow coating methods (also referred to herein as a "flow coatable fluororesin") to provide desirable surface properties suitable for fusing processes. As disclosed herein, the term "flow-coatable" refers to a material that is able to be applied by flow coating methods known in the art to achieve a smooth and even coating.

Exemplary materials used for the flow-coatable fluororesin can include fluororesins such as fluoroplastics and fluorinated polyethers. In embodiments, specific examples of fluororesins include, but are not limited to, polytetrafluoroethylene (PTFE), perfluoroalkoxy polymer resin (PFA), poly(tetrafluoroethylene-co-perfluoropropyl vinyl ether), fluorinated ethylenepropylene copolymer (FEP), other like fluororesins, and combinations thereof. Non-limiting commercially available fluororesins include TEFLON® PFA (polyfluoroalkoxypolytetrafluoroethylene), TEFLON® PTFE (polytetrafluoroethylene), or TEFLON® FEP (fluorinated ethylenepropylene copolymer), available from E.I. DuPont de Nemours, Inc. (Wilmington, Del.). The TEFLON® designation is a Trademark of E.I. DuPont de Nemours, Inc.

As disclosed herein, the fluororesin can be dissolved or dispersed in solution with a sacrificial polymeric binder to form a dispersion. In an aspect, the dispersion comprises a sacrificial polymeric binder to stabilize the fluororesin in solution. Non-limiting exemplary materials for the sacrificial polymeric binder can include poly(alkylene carbonates), such as poly(propylene carbonate), poly (ethylene carbonate), poly(butylenes carbonate), poly(cyclohexene carbonate), and the like, and combinations thereof. In an embodiment, the sacrificial polymeric binder can have a weight average molecular weight ranging from about 50,000 to about 500,000, for example from about 75,000 to about 400,000, such as from about 100,000 to about 200,000. In an aspect, the sacrificial polymeric binder can be a poly(alkylene carbonate). Non-limiting commercially available sacrificial polymeric binder materials can include poly(propylene carbonate) having a decomposition point of about 250° C., such as that produced through the copolymerization of carbon dioxide with one or more epoxides, available from Empower Materials (New Castle, Del.). An important characteristic for the sacrificial polymeric binder is the ability to be removed from the final topcoat, and any residual should remain inert to the final topcoat. In other words, the sacrificial polymeric binder should not affect the final properties of the topcoat even after decomposition. The sacrificial polymeric binder should be selected to decompose at a temperature below the melting temperature of the fluororesin. Binders that decompose at higher temperatures (such as >320° C.), e.g. polyvinylbutyral (PVB) and acrylic polymers, are not desirable herein. In an embodiment, the sacrificial polymeric binder can be poly(propylene carbonate) and the like, which decomposes into water and carbon dioxide.

The fluororesin can be present in the dispersion, with a sacrificial polymeric binder, in an amount ranging from about 20 to about 60 percent, for example from about 25 to about 50 percent, such as from about 30 to about 40 percent, based on the total weight of the dispersion. The sacrificial polymeric binder can be present in the dispersion in an amount ranging from about 1 to about 30 percent, for example from about 2 to about 20 percent, such as from about 5 to about 10 percent, based on the amount of total solids in the dispersion. Total solids content can be calculated by any known method in the art. See, e.g., *Determination of Total Solids in Resin Solutions*, McKinney et al., *Ind. Eng. Chem. Anal.* Ed., 1946, 18 (1), pp 14-16. The dispersion can have a viscosity ranging from about 50 cP to about 1,000 cP.

Without being limited by theory, it is believed that the sacrificial polymeric binder can stabilize the flow-coatable fluororesins in the dispersion such that the dispersion can be uniformly coated onto a substrate by flow coating methods to form a smooth, uniform topcoat layer. In other words, the sacrificial polymeric binder, having appropriate molecular weight and viscosity in solvent media, can provide the dispersion with stability and suitable rheology so that it can be applied using flow coating methods. Unlike fluoroelastomers, such as Viton elastomers which are typically soluble in solvent, fluoroplastics (such as the PFA fluororesins discussed above) are typically insoluble and difficult to use in flow coating methods. In this way, the sacrificial polymeric binder can help stably suspend the flow-coatable fluororesins in a dispersion. The dispersion can then be applied using flow coating methods.

The sacrificial polymeric binder can subsequently be removed (e.g., by decomposing, evaporating, burning away, or the like), after flow coating, by heating at a temperature above its melting point. Thus, the sacrificial polymeric binder is removable from the final PFA topcoat, and therefore does not affect the final properties of the topcoat.

In this way, a fluororesin that is otherwise difficult to stabilize in solutions or dispersions may be used in flow coating methods to form the fuser topcoat. In an embodiment, a fuser member can be manufactured by flow coating a substrate, a silicone layer over the substrate, and a PFA topcoat layer over the silicone layer, all in a single manufacturing process.

In embodiments, the dispersion can include at least one solvent. The solvent can be aqueous and/or organic solvent, or a mixture of solvents. Exemplary organic solvents include acetone, methylethylketone, cyclohexanone, ethyl acetate, methoxy ethyl ether, methylene chloride, and the like, and combinations thereof. In embodiments, the solvent is methylethylketone (MEK) or a mixture of MEK and cyclohexanone.

In embodiments, the dispersion can further include an additive material including, but not limited to, silica, clay, metal oxides nanoparticles, carbon nanotubes, carbon nanofibers, and the like.

In embodiments, the dispersion can further include a surfactant. The surfactant can be a methacrylate-based fluorosurfactant. These types of surfactants are described in U.S. Pat. No. 7,462,395, the disclosure of which is incorporated herein by reference in its entirety. Commercially available examples of methacrylate-based fluorosurfactants include, but are not limited to, GF300 and/or GF400 (poly(fluoroacrylate)-graft-poly(methyl methacrylates), available from Toagosei Chemical Industries), and the like and combinations thereof. The surfactant can be present in the dispersion in an amount ranging from about 0.1 wt. % to about 5 wt. %, for example from about 0.5 to about 3 wt. %, such as from about 1 to about 3 XX wt. %, based on the total weight of the fluororesin particles. Without being limited by theory, it is believed that the surfactant can uniformly disperse the fluororesins, and any fluorinated fillers, in the dispersion to avoid uneven fluororesin clumping. Thus, the dispersion can be easily and uniformly coated onto a substrate, and coating defects (e.g., "barber poles") are minimized or eliminated.

The dispersion can be applied using flow coating methods. In an embodiment, the dispersion can be flow coated onto a substrate. In another embodiment, the dispersion can be flow coated with a silicone layer onto a substrate in an all-in-one manufacturing fashion. After flow coating the disclosed dispersion onto a substrate, the coated substrate can subsequently be heated to a first temperature at or above the melting point of the sacrificial polymeric binder but below the melting point of the fluororesin, and then heating to a second temperature at or above the melting point of the fluororesin. For example, the coated substrate can be heated to a first temperature ranging from about 100° C. to about 280° C., such as from about 150° C. to about 270° C., for example from about 200° C. to about 250° C. Without being limited by theory, it is believed that heating to the first temperature removes (e.g., by decomposing, evaporating, burning away, or the like) the sacrificial polymeric binder from the topcoat layer. However, a trace amount of the binder may be left in the topcoat layer due to incomplete removal. In an aspect, after heating to the first temperature, the sacrificial binder can be present in the topcoat layer in an amount ranging from about 0% to about 5% by weight, for example from about 0.1 to about 3 wt. %, such as from about 0.5 to about 1 wt. %, relative to the total weight of the topcoat composition.

The coated substrate can be heated to a second temperature ranging from about 285° C. to about 380° C., such as from about 300° C. to about 360° C., for example from about 310° C. to about 350° C. Heating to the second temperature can melt the fluororesin to form a continuous coating, i.e., topcoat layer.

The topcdat layer can have desirable surface energy, for example, about 25 $mN/m^2$ or less, such as a surface energy ranging from about 25 $mN/m^2$ to about 1 $mN/m^2$, or from about 22 $mN/rn^2$ to about 5 $mN/m^2$, or from about 20 $mN/m^2$ to about 10 $mN/m^2$. This low surface energy can control surface release performance, for example of a fuser member in an electrophotographic printing device.

The topcoat layer can possess desirable mechanical properties. For example, the topcoat layer can have a tensile strength ranging from about 500 psi to about 5,000 psi, or from about 1,000 psi to about 4,000 psi, or from about 1,500 psi to about 3,500 psi; an elongation % ranging from about 20% to about 1000%, or from about 50% to about 500%, or from about 100% to about 400%; a toughness ranging from about 500 in.-lbs./in.$^3$ to about 10,000 or from about 1,000 in.-lbslin.$^3$ to about 5,000 or from about 2,000 in.-lbs./in.$^3$ to about 4,000 in.-lbs./in.$^3$; and an initial modulus ranging from about 100 psi to about 2,000 psi, or from about 500 psi to about 1,500 psi, or from about 800 psi to about 1,000 psi.

The topcoat layer can have a desirable thermal diffusivity ranging from about 0.01 $mm^2/s$ to about 0.5 $mm^2/s$, or from about 0.05 $mm^2/s$ to about 0.25 $mm^2/s$, or from about 0.1 $mm^2/s$ to about 0.15 $mm^2/s$, and a desirable average thermal conductivity ranging from about 0.01 W/mK to about 1.0 W/mK, or from about 0.1 W/mK to about 0.75 W/mK, or from about 0.25 W/mK to about 0.5 W/mK.

In embodiments, the topcoat layer can be used in any suitable electrophotographic members and devices. For example, the topcoat layer can be used for a printer member in electrophotographic devices including, but not limited to, a fuser member, a pressure member, and/or a donor member. The topcoat layer can be thin and can have a thickness ranging from about 50 nm to about 3 μm, or from about 100 nm to about 3 μm, or from about 500 nm to about 2 μm.

The printer member can be in a form of, for example, a roll, a drum, a cylinder, or a roll member as shown in FIGS. 1A-1B and FIGS. 2A-2B. In some embodiments, the printer member can be in a form of a belt, a drelt, a plate, a sheet, or a belt member as shown in FIGS. 3A-3B and FIGS. 4A-4B.

Figure 1B:
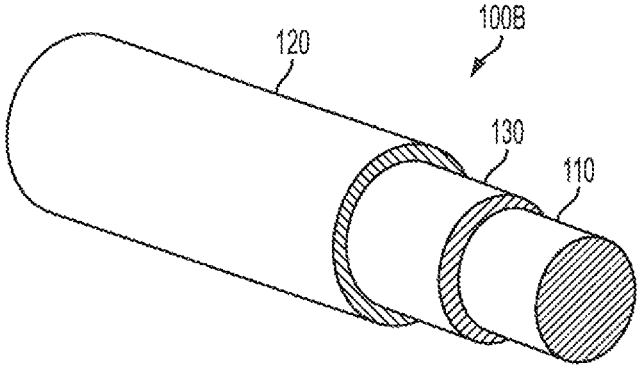

Referring to FIGS. 1A-1B, the fuser member 100A-B can include a substrate 110 and a topcoat layer 120 formed over the substrate 110. The topcoat layer 120 can include, for example, the flow-coatable fluororesins described herein.

In embodiments, the substrate 110 can be a cylindrical substrate taking the form of a cylindrical tube, e.g., having a hollow structure including a heating lamp therein, or a solid cylindrical shaft. The substrate 110 can be made of a material including, but not limited to, a metal, a polymer (e.g., plastic), and/or a ceramic. For example, the metal can include aluminum, anodized aluminum, steel, nickel, and/or copper. The plastic can include, for example, polyimide, polyester, polyketone such as polyetheretherketone (PEEK), poly (arylene ether), polyamide, polyaramide, polyetherimide, polyphthalamide, polyamide-imide, polyphenylene sulfide, fluoropolyimide and/or fluoropolyurethane.

The topcoat layer 120 can be formed directly on the substrate 110 as exemplarily shown in FIG. 1A. In various embodiments, one or more additional functional layers, depending on the member applications, can be formed between the topcoat layer 120 and the substrate 110. For example, the member 1008 can have a 2-layer configuration having a compliant/resilient layer 130, such as a silicone rubber layer, disposed between the topcoat layer 120 and the substrate 110. In another example, the exemplary fuser member can include an adhesive layer (not shown), for example, formed between the resilient layer 130 and the substrate 110 or between the resilient layer 130 and the topcoat layer 120.

Figure 2A:
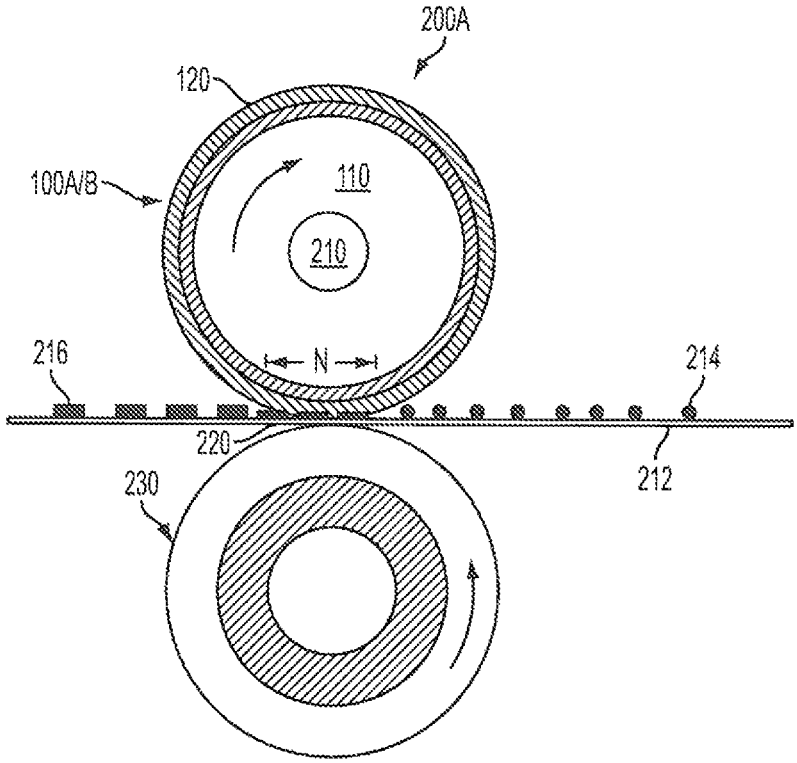
FIGS. 2A-2B depict exemplary fusing apparatuses having the fuser rolls of FIGS. 1A-1B in accordance with various embodiments of the present teachings.
Figure 2B:
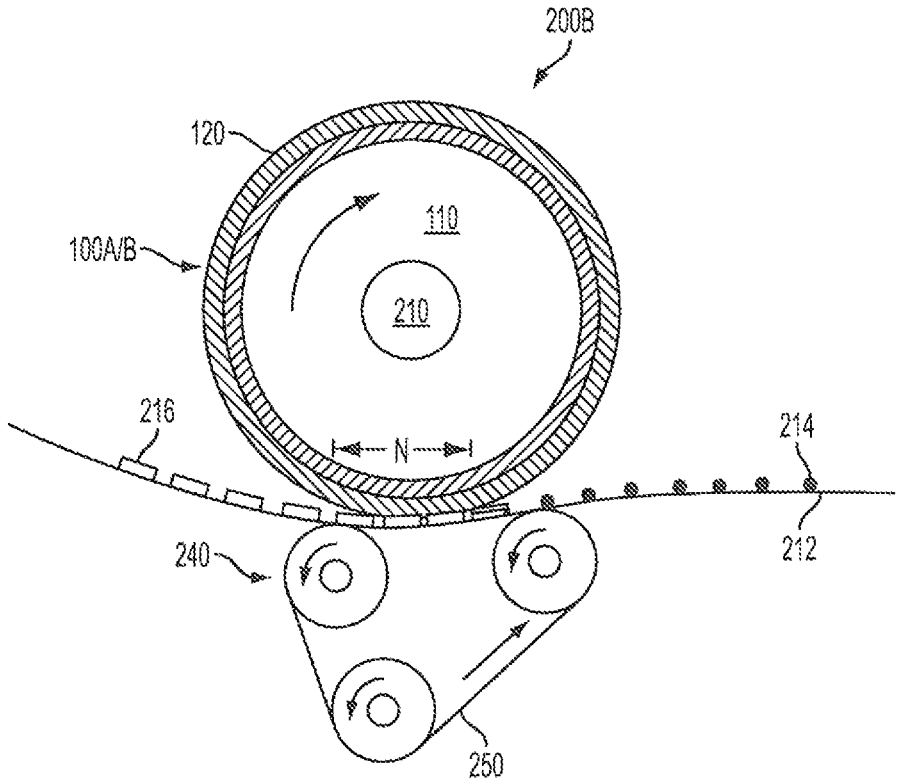

As disclosed herein, the exemplary fuser member 100A-B can be used in a conventional fusing system to improve fusing performances. FIGS. 2A-2B depict exemplary fusing apparatuses 200A-B using the disclosed member 100A or 100B of FIGS. 1A-1B.

The exemplary fusing apparatuses 200A-B can include the exemplary fuser member 100A/B having a topcoat layer 120 over a suitable substrate 110, e.g., a hollow cylinder fabricated from any suitable metal. The fuser member 200A/B can further be incorporated with a suitable heating element 210 disposed in the hollow portion of the substrate 110 which is coextensive with the cylinder. Backup (or pressure) roll 230 (see FIG. 2A) or a backup (or pressure) belt 250 (see FIG. 2B) can cooperate with the fuser member 200A/B to form a contact nip N through which a print medium 212 such as a copy paper or other print substrate passes, such that toner images 214 on the print medium 212 contact the topcoat layer 120 during the fusing process. The mechanical component 235 can include one or more rolls cooperated to move the pressure belt 218. The fusing process can be performed at a temperature ranging from about 60° C. (140° F.) to about 300° C. (572° F.), or from about 93° C. (200° F.) to about 232° C. (450° F.), or from about 160° C. (320° F.) to about 232° C. (450° F.). Following the fusing process, after the print medium 212 passing through the contact nip N, fused toner images 216 can be formed on the print medium 212.

Figure 3A:
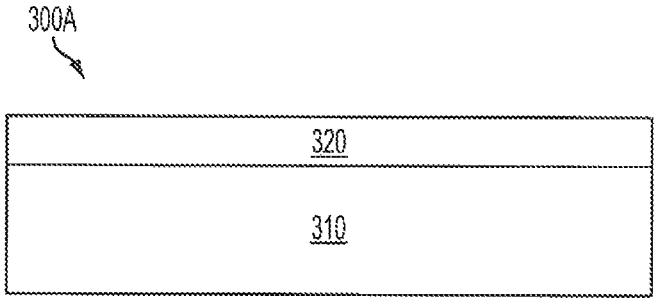
FIGS. 3A-3B depict exemplary fuser belts having the exemplary non-woven fabric disclosed herein in accordance with various embodiments of the present teachings.
Figure 3B:
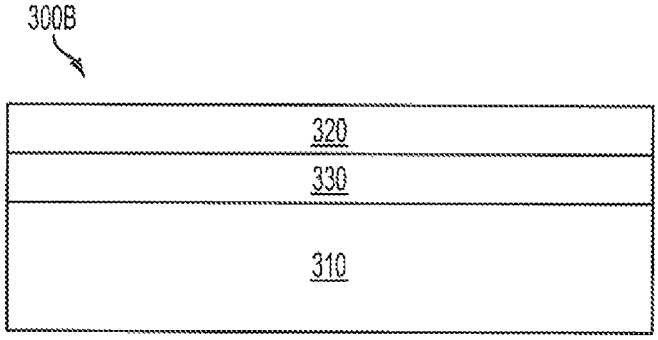

In embodiments, the fuser member can be a fuser belt having a topcoat layer 320 formed over a belt substrate 310 as shown in FIGS. 3A-3B. In other embodiments, a layer 330 (e.g., a compliant/resilient layer or adhesive layer) can be disposed between the topcoat layer 320 and the substrate 310. As described herein, the topcoat layer 320 can include the flow-coatable fluororesins disclosed herein.

Compared with the fuser rolls 100A-B shown in FIGS. 1A-1B, the fuser belts 300A-B can have the belt substrate 310. The belt substrate 310 can be any suitable belt substrate as known to one of ordinary skill in the art. For example, the belt substrate 310 can include high temperature plastics that are capable of exhibiting a high flexural strength and high flexural modulus. The belt substrate 310 can alternatively include a film, sheet, or the like and can have a thickness ranging from about 25 micrometers to about 250 micrometers. The belt substrate 310 can include, for example, polyimide, polyester, polyketone such as polyetheretherketone (PEEK), poly(arylene ether), polyamide, polyaramide, polyetherimide, polyphthalamide, polyamide-imide, polyphenylene sulfide, fluoropolyimide and/or fluoropolyurethane.

Figure 4B:
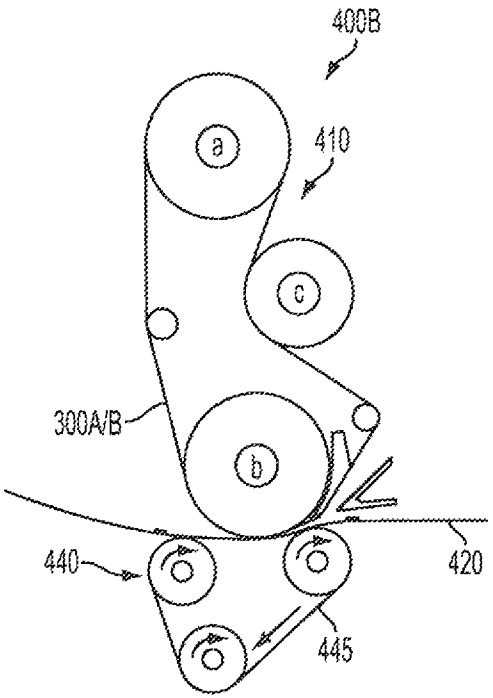
FIGS. 4A-4B depict exemplary fusing apparatuses having the fuser belts of FIGS. 3A-3B in accordance with various embodiments of the present teachings.
Figure 4A:
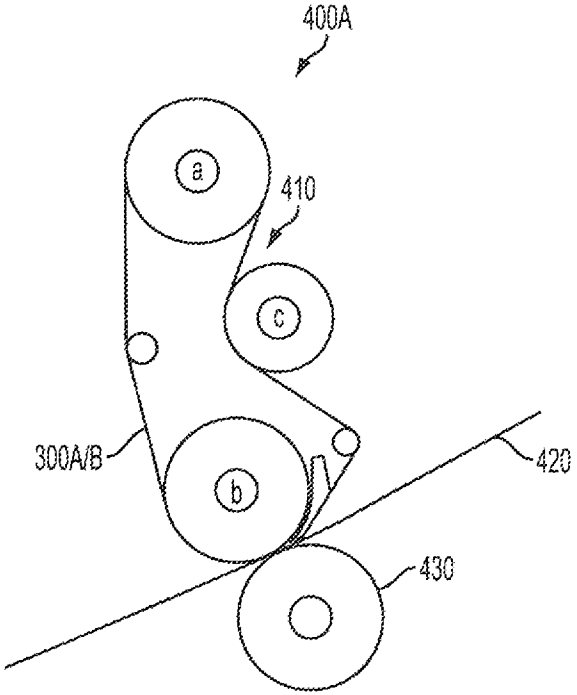

FIGS. 4A-4B depict exemplary fusing apparatuses 400A-B using the fuser belt shown in FIGS. 3A-3B in accordance with various embodiments of the present teachings. The apparatus 400A/B can include a fuser belt 300A/B that forms a contact nip with, for example, a pressure roll 430 in FIG. 4A or a pressure belt 445 of FIG. 2B. A print medium 420 having unfixed toner images (not illustrated) can then pass through the contact nip N to fuse the unfixed toner images on the print medium 420. In embodiments, the pressure roll 430 or the pressure belt 445 can be used in a combination with a heat lamp to provide both the pressure and heat for fusing the toner images on the print medium 420. In addition, the apparatus 400A/B can include a mechanical component 410 to move the fuser belt 300A/B and thus fusing the toner images and forming images on the print medium 420. The mechanical component 410 can include one or more rolls 410*a-c*, which can also be used as heat rolls when needed.

In an aspect, there is disclosed herein a method of producing a fuser member, including providing a substrate; providing a dispersion comprising at least one fluororesin, at least one sacrificial polymeric binder, and solvent; applying the dispersion to the substrate by flow coating to form a topcoat; heating the topcoat to a first temperature ranging from about 100° C. to about 280° C.; and heating the topcoat to a second temperature ranging from about 285° C. to about 380° C.

In another aspect, there is disclosed a fuser apparatus including a fuser member. The fuser member can include a substrate and a topcoat layer, wherein the topcoat layer includes a flow-coated fluororesin and has a surface energy of about 25 mN/m$^2$ or less. The fuser apparatus can further include a pressure member configured to form a contact nip with the topcoat layer of the fuser member to fuse toner images on a print medium that passes through the contact nip Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

EXAMPLES

Comparative Example 1

About 40 weight percent of PFA powder (MP320, available from E. I. du Pont de Nemours, Inc.) was dispersed in methylethylketone (MEK) solvent and sonicated multiple times to form a PFA dispersion. The PFA dispersion was applied by flow coating onto a silicone roll (Olympia roll) having a clear primer. The roll was baked for 30 minutes at 250° C., followed by further baking for 8 minutes at 350° C., to form a fuser roll with PFA topcoat. The topcoat was approx. 20-30 μm thick, and was observed to be uneven and non-uniform. It was not possible to produce an integral film by flow coating with the PFA dispersion, as it was believed (without intending to be limited by theory) that the PFA particles moved on the roll surface as the solvent evaporated, resulting in uneven, non-uniform patches of PFA in the topcoat. Accordingly, it was not possible to determine the tensile strength, toughness, thermal diffusivity, or like properties, of the PFA topcoat.

Inventive Example 1

About 40 weight percent of PFA powder (MP320, available from E. I. du Pont de Nemours, Inc.) was dispersed in MEK solvent and sonicated multiple times to form a PFA dispersion. A separate MEK solution containing about 20 weight percent of a poly(propylene carbonate) (PPC) with a molecular weight of 265,000 g/mol (QPAC® 40, available from Empower Materials) was added to the PFA dispersion to form a stable coating dispersion containing 10 weight percent poly(propylene carbonate). The stable coating dispersion was applied by flow coating onto a silicone roll (Olympia roll) having a clear primer. The roll was baked for 30 minutes at 250° C. to remove the poly(propylene carbonate), followed by further baking for 8 minutes at 350° C. to melt the PFA and form a fuser roll with PFA topcoat. The topcoat was approx. 50 μm thick, and observed to be smooth and even. The topcoat had a surface energy of approx. 19-21 mN/m$^2$.

Mechanical testing of Inventive Example 1 (peeled from the roll after curing), according to ASTM D638 protocol on an Instron® 3367, showed tensile properties very similar to conventional spray-coated PFA films, as shown in Table 1 below:

TABLE 1

| | | Temperature Testing ° C. | Breaking Stress psi | Breaking Strain % | Initial Modulus psi | Toughness in.-lbs./in.$^3$ |
|---|---|---|---|---|---|---|
| Spray-coated Topcoat | PFA | 23 | 3644 | 263 | 56723 | 6303 |
| Inventive Example 1 | PFA/PPC | 23 | 3253 | 254 | 43734 | 5532 |

As shown in Table 1, a fuser topcoat according to Inventive Example 1 (formed by flow coating methods using PFA dispersion) performed equally as well under mechanical evaluation as conventional spray-coated topcoats. Moreover, because Inventive Example 1 was applied via flow coating, the process provides a more efficient metered coating process without the adverse side effects associated with spray coating, such as toxic airborne atomized PFA particles and overspray loss. Inventive Example 1 also provides a cost-effective manufacturing process by utilizing existing manufacturing lines, thereby reducing manufacturing capital costs as compared to spray coating methods.

Inventive Example 2

About 40 weight percent of PFA powder (MP320) was dispersed in MEK solvent and sonicated multiple times to form a PFA dispersion. About 1 weight percent of GF300 surfactant (available from Toagosei Co. Ltd.) was then added to the PFA dispersion. A separate MEK solution containing about 20 weight percent of PPC (QPAC® 40) was added to the PFA dispersion to form a stable coating dispersion containing about 5 weight percent PPC. Minimal PFA clumping was observed in the stable coating dispersion. The stable coating dispersion was applied by flow coating onto a silicone roll (Olympia roll) having a clear primer. The roll was baked for 30 minutes at 160° C., followed by further baking for 12 minutes at 350° C. to melt the PFA and form a fuser roll with PFA topcoat. The topcoat was =30 μm thick, and observed to be defect-free. The topcoat had a surface energy of approx. 19~21 mN/m.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method of producing a fuser member, comprising:

providing a substrate;

providing a dispersion comprising at least one fluororesin, at least one sacrificial polymeric binder, and at least one solvent;

applying the dispersion to the substrate by flow coating to form a topcoat;

heating the topcoat to a first temperature ranging from about 100° C. to about 280° C.; and heating the topcoat to a second temperature ranging from about 285° C. to about 380° C. to form a uniform topcoat on a fuser member.

2. The method of claim 1, wherein the fluororesin is selected from the group consisting of polytetrafluoroethylene (PTFE), perfluoroalkoxy polymer resin (PFA), poly(tetrafluoroethylene-co-perfluoropropyl vinyl ether), fluorinated ethylenepropylene copolymer (FEP); and combinations thereof.

3. The method of claim 1, wherein the sacrificial polymeric binder is a poly(alkylene carbonate) selected from the group consisting of poly(propylene carbonate), poly(ethylene carbonate), poly(butylenes carbonate), poly(cyclohexene carbonate), and combinations thereof.

4. The method of claim 3, wherein the poly(alkylene carbonate) comprises a weight average molecular weight ranging from about 50,000 to about 500,000.

5. The method of claim 1, wherein the dispersion comprises a viscosity ranging from about 50 cP to about 1000 cP.

6. The method of claim 1, wherein the solvent is selected from the group consisting of acetone, methylethylketone, cyclohexanone, ethyl acetate, methoxy ethyl ether, methyl chloride, and combinations thereof.

7. The method of claim 1, wherein the dispersion further comprises an additive selected from the group consisting of silica, clay, metal oxides, nanoparticles, carbon nanotubes, carbon nanofibers, and combinations thereof.

8. The method of claim 1, wherein the dispersion further comprises a methacrylate-based fluorosurfactant in an amount ranging from about 0.1 wt. % to about 5 wt. %, based on the total weight of the fluororesin particles.

9. The method of claim 1, wherein the sacrificial polymeric binder is present in the dispersion in an amount ranging from about 1 to about 30 percent, based on the amount of total solids in the dispersion.

10. The method of claim 1, wherein the fluororesin is present in the dispersion in an amount ranging from about 20 to about 60 percent, based on the total weight of the dispersion.

11. The method of claim 1, wherein the topcoat of the fuser member comprises from about 0% to about 5% by weight of the sacrificial polymeric binder.

12. A fusing apparatus comprising:

a fuser member comprising a substrate and a topcoat layer, wherein the topcoat layer comprises a flow-coated fluororesin and has a surface energy of about 25 mN/m or less and the topcoat layer has a toughness ranging from about 100 in.-lbs./in.$^3$to about 10,000 in.-lbs./in.$^3$; and a pressure member configured to form a contact nip with the topcoat layer of the fuser member to fuse toner images on a print medium that passes through the contact nip.

13. The fusing apparatus of claim 12, wherein the flow-coated fluororesin is selected from the group consisting of polytetrafluoroethylene (PTFE), perfluoroalkoxy polymer resin (PFA), poly(tetrafluoroethylene-co-perfluoropropyl vinyl ether), fluorinated ethylenepropylene copolymer (FEP); and combinations thereof.

14. The fusing apparatus of claim 13, wherein the flow-coated fluororesin comprises a perfluoroalkoxy polymer resin (PFA).

15. The fusing apparatus of claim 12, wherein the topcoat layer has a thickness ranging from about 5 μm to about 70 μm.

16. The fusing apparatus of claim 12, wherein the topcoat layer further comprises an additive selected from the group consisting of silica, clay, metal oxides, nanoparticles, carbon nanotubes, carbon nanofibers, filler fluoropolymers, and combinations thereof.

17. The fusing apparatus of claim 12, wherein the topcoat layer further comprises from about 0.1% to about 5% of a sacrificial polymeric binder.

18. The fusing apparatus of claim 12, wherein the topcoat layer has a tensile strength ranging from about 100 psi to about 8,000 psi.

19. The fusing apparatus of claim 12, wherein the topcoat layer has a thermal diffusivity ranging from about 0.01 mm$^2$/s to about 0.5 mm$^2$/s.

* * * * *